US007448172B1

(12) United States Patent
Knodel

(10) Patent No.: US 7,448,172 B1
(45) Date of Patent: Nov. 11, 2008

(54) WALL BASE PLATE TO CONCRETE ANCHORING SYSTEM

(76) Inventor: Freddy Knodel, 10419 Rawlings Dr., Pensacola, FL (US) 32514

( * ) Notice: Subject to any disclaimer, the term of this patent is extended or adjusted under 35 U.S.C. 154(b) by 849 days.

(21) Appl. No.: 10/859,644

(22) Filed: Jun. 4, 2004

(51) Int. Cl.
*E04C 5/01* (2006.01)

(52) U.S. Cl. ..... 52/98; 52/293.3; 52/295; 52/701; 52/707; 52/709

(58) Field of Classification Search ..... 52/293.3, 52/295, 698–701, 704–711, 98; 249/24, 249/42, 43, 207, 217, 219.1; 248/314
See application file for complete search history.

(56) References Cited

U.S. PATENT DOCUMENTS

| | | | | | |
|---|---|---|---|---|---|
| 1,089,874 | A | | 3/1914 | Smith | |
| 1,108,859 | A | | 8/1914 | Bennet | |
| 1,199,077 | A | | 9/1916 | James | |
| 1,726,286 | A | | 8/1929 | Bennet | |
| 1,960,728 | A | | 5/1934 | Cannon | |
| 2,911,702 | A | * | 11/1959 | Clyncke | 249/207 |
| 2,952,947 | A | | 9/1960 | White | |
| 3,150,429 | A | | 9/1964 | Shaffer | |
| 3,401,733 | A | | 9/1968 | Circle | |
| 3,500,607 | A | | 3/1970 | Wilson | |
| 3,552,734 | A | | 1/1971 | Severino | |
| 3,597,893 | A | | 8/1971 | Spanel | |
| 3,912,218 | A | | 10/1975 | Lister | |
| 3,960,356 | A | | 6/1976 | Adams | |
| 3,964,219 | A | | 6/1976 | Hala | |
| 3,989,219 | A | * | 11/1976 | Pruett | 249/24 |
| 4,261,544 | A | | 4/1981 | Addison | |
| 4,283,899 | A | | 8/1981 | Wakamiya | |
| 4,309,135 | A | | 1/1982 | Gutshall | |
| 4,380,329 | A | | 4/1983 | Nunno | |
| 4,408,940 | A | | 10/1983 | Fischer | |
| 4,641,478 | A | | 2/1987 | Nelson, Jr. | |
| 4,932,818 | A | | 6/1990 | Garwood | |
| 5,050,364 | A | | 9/1991 | Johnson et al. | |
| 5,060,436 | A | | 10/1991 | Delgado, Jr. | |
| 5,174,910 | A | | 12/1992 | Pita | |
| 5,240,224 | A | | 8/1993 | Adams | |
| 5,337,534 | A | * | 8/1994 | Nasca | 52/295 |
| 5,388,804 | A | | 2/1995 | Cohen et al. | |
| 5,625,993 | A | * | 5/1997 | Kelly | 52/704 |
| 5,787,672 | A | * | 8/1998 | Giannuzzi et al. | 52/698 |
| 5,836,132 | A | | 11/1998 | Weathersby | |
| 6,065,730 | A | * | 5/2000 | Marks et al. | 248/314 |
| 6,079,179 | A | | 6/2000 | Shoemaker, Jr. | |
| 6,431,517 | B1 | | 8/2002 | Chapman | |
| 7,021,022 | B2 | * | 4/2006 | Hearne | 52/293.3 |

* cited by examiner

*Primary Examiner*—Richard E. Chilcot, Jr.
*Assistant Examiner*—Matt J Smith
(74) *Attorney, Agent, or Firm*—Peter Loffler

(57) ABSTRACT

A wall anchoring system is used to secure a stud wall to a foundation of a building. An anchor has an open bottom for receiving a connector which threadably receives an anchor bolt and an open top that is covered by a removable seal tab, the seal tab having a depth gauge to control the level of anchor bolt insertion. A clip is attached to the anchor and is used to secure the device to a concrete block header prior to foundation pour. Once the foundation is poured, the seal tab is removed, either by being detached along a frangible connection or by being punctured in order to expose the open top of the anchor. A securement bolt is passed through the base plate of the stud wall and is received within the anchor.

23 Claims, 5 Drawing Sheets

WALL BASE PLATE TO CONCRETE ANCHORING SYSTEM

BACKGROUND OF THE INVENTION

1. Field of the Invention

The present invention relates to an anchoring system that secures a wall to a foundation of a building wherein the anchoring system is preset prior to foundation pour and is easily located and made operational and does not interfere with foundation screeding or leveling.

2. Background of the Prior Art

Anchors are used to secure a wall of a building to the foundation. Typically, a securement bolt passes through the base plate of the stud wall of the building and is received within an appropriate anchor secured within the foundation. Several such bolts are positioned along the length of each wall at appropriately spaced intervals. The proper functioning of this anchoring system is critical especially to shear walls—wall that take wind loads—in order to assure the integrity of the building being built.

Such securement bolts can be used to secure the stud wall to the foundation after the foundation has been poured and hardened, sometimes years earlier. Such bolts pass through the base plate of the stud wall and are drilled or driven into the hardened foundation, oftentimes being set in place with epoxy or similar material. This system, which tends not to be as strong as other systems due to the fact that the bolt's receipt within the foundation represents the entire anchoring system, is typically used in remodeling wherein the walls of the building are being changed or rebuilt and is also used when an anchoring bolt was missed during foundation pour. In many jurisdictions, the bore hole into which such bolts are set must be inspected by building officials, resulting in building delay.

The other type of securement bolt uses an anchoring system that is set within the foundation of the building prior to the concrete of the foundation being hardened. Once the foundation is set, a bolt passes through the base plate of the stud wall and is received within the anchoring system that is set within the foundation. As the anchoring system is set within the foundation once the foundation hardens, this type of anchoring system provides a very strong securement of the stud wall to the foundation. Generally, there are two major methods whereby the anchor of the anchoring system is set within the foundation. One such method has the anchor placed into the foundation after the foundation is poured but before it is set. The problem with setting the anchors into the foundation after foundation pour is that anchors can be misplaced in a given location or entirely omitted from a particular location. Due to the limited time available between concrete pour and concrete hardening to the point that an anchor can no longer be inserted thereinto, especially if a low slump concrete is being poured, such mistakes are bound to happen with the remedy being the use of the less than desirable after the fact securement bolts with their lessened strength capabilities.

The other major method for anchoring system placement within a foundation is to preset the anchors prior to the foundation pour, sometimes days prior, when limited time is not a factor and a person's work can be checked and rechecked to assure that each anchor is properly positioned and each location requiring an anchor, in fact has an anchor thereat. Once the foundation is poured and set, the stud wall is positioned and the securement bolt is passed through the base plate of the stud wall and is received within the anchor that is set within the foundation, thereby securing the stud wall to the foundation. While many contractors prefer this second type of anchor, such anchoring systems have drawbacks. One drawback in many systems is that the concrete is poured entirely over the anchor and once the foundation is set, the receiver of the anchor that receives the securement bolt, must be located and cleaned of the concrete that has hardened over it. This process is labor intensive and time-consuming. In order to address this problem, anchoring systems have been proposed wherein either the receiver of the anchor or at least a locator are positioned above the foundation for easier location and use thereof when the foundation is set. While these systems minimize the problem of anchor system location and operation capacity immediately after foundation set, by being partially positioned above the level of the foundation, these anchoring systems tend to interfere with the screeding and the leveling process of the foundation immediately after concrete pour resulting in increased labor time to screed and level the foundation and oftentimes leaving the foundation finish less than ideal especially proximate the anchoring system location.

Accordingly, there exists a need in the art for an anchoring system that is used to secure walls to a foundation of a building and properly and securely hold the walls in place, even shear walls, which system addresses the above-stated problems. Such an anchoring system must allow the anchor to be preset prior to concrete pour so that time pressures are not an issue in order to allow for proper placement of the anchoring system. The anchoring system must be easily locatable after the foundation is poured and set and must be made operational with minimal effort. The anchoring system should not interfere with the screeding or leveling process of the poured foundation in order to allow a proper finish to be imparted onto the foundation. Ideally, the anchoring system should be of relatively simple construction and should be easy and straightforward to use.

SUMMARY OF THE INVENTION

The wall anchoring system of the present invention addresses the aforementioned needs in the art. The wall anchoring system secures walls to a foundation of a building and properly and securely hold the walls in place, even shear walls. The wall anchoring system presets the anchor prior to concrete pour when time pressures are not an issue thereby facilitating proper placement of the anchoring system within the foundation. The wall anchoring system is easily locatable after the foundation is poured and is made operational with minimal effort. The anchoring system does not interfere with the screeding or leveling process of the poured foundation allowing a proper finish to be imparted onto the foundation. The anchoring system is of relatively simple construction and is easy and straightforward to use.

The wall anchoring system of the present invention is comprised of an anchor that has an open bottom and an open top. A connector having an anchor bolt threadably received therein is received within the open bottom of the anchor. A seal housing is attached to the anchor, the seal housing having a seal tab that removably covers the open top of the anchor. A clip is attached to the seal housing and is laterally offset from the anchor. The clip is attached to a concrete block (including other form material) and once a foundation is poured, the seal tab is removed from the anchor, exposing the open top such that a securement bolt passes through a base plate and is threadably received within the open top of the anchor. The seal tab has a depth gauge thereon that extends toward the bottom of the anchor whenever the seal tab is in covering relationship with the top such that the depth gauge controls the depth of insertion of the anchor bolt into the connector whenever the connector is received within the bottom of the anchor. The seal tab is frangibly connected to the seal housing and is removed from the seal housing along this frangible connection. The clip may be either fixedly or removably attached to the seal housing. If the clip is removably attached to the seal housing, the clip may be received within a pair of slots located on the seal housing. The seal tab may also be removed from covering relationship with the open top by being punctured. The seal housing may be dual sectioned such that it is comprised of a first section attached to the anchor and a second section removably attached to the first section with the clip attached to the second section with the second section providing the lateral offset between the anchor and the clip.

BRIEF DESCRIPTION OF THE DRAWINGS

Similar reference numerals refer to similar parts throughout the several views of the drawings.

DESCRIPTION OF THE PREFERRED EMBODIMENT

Figure 1:
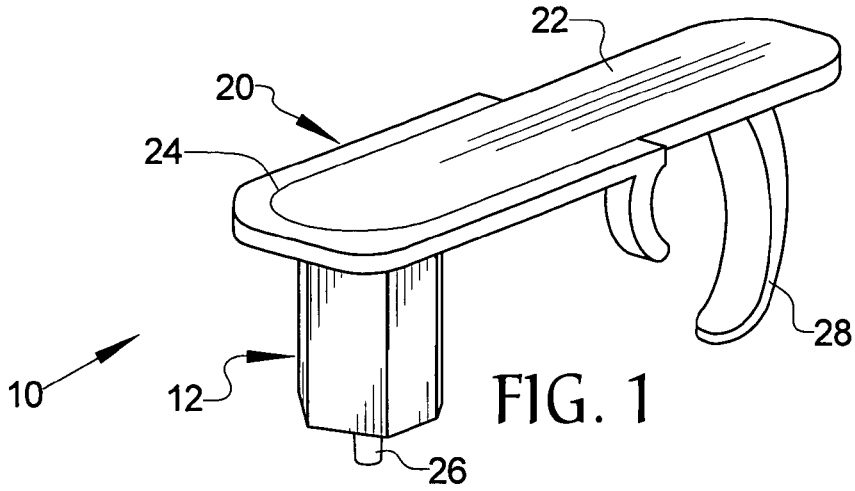
FIG. 1 is a perspective view of the wall anchoring system of the present invention.
Figure 2:
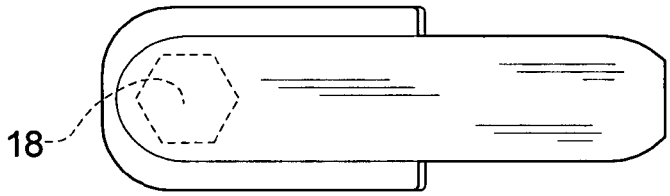
FIG. 2 is a top plan view of the wall anchoring system.
Figure 3:
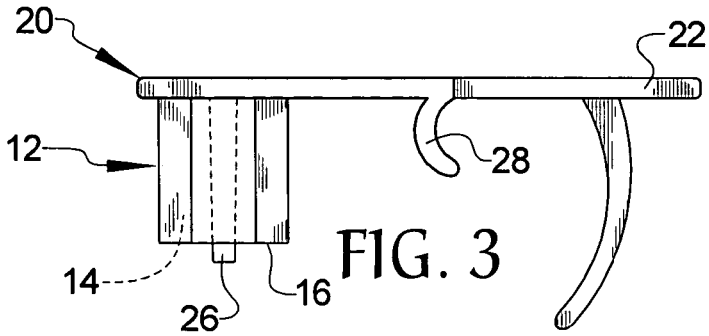
FIG. 3 is a side elevation view of the wall anchoring system.
Figure 4:
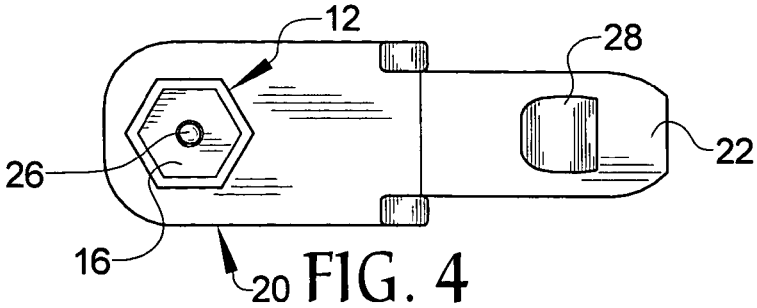
FIG. 4 is a bottom plan view of the wall anchoring system.
Figure 5:
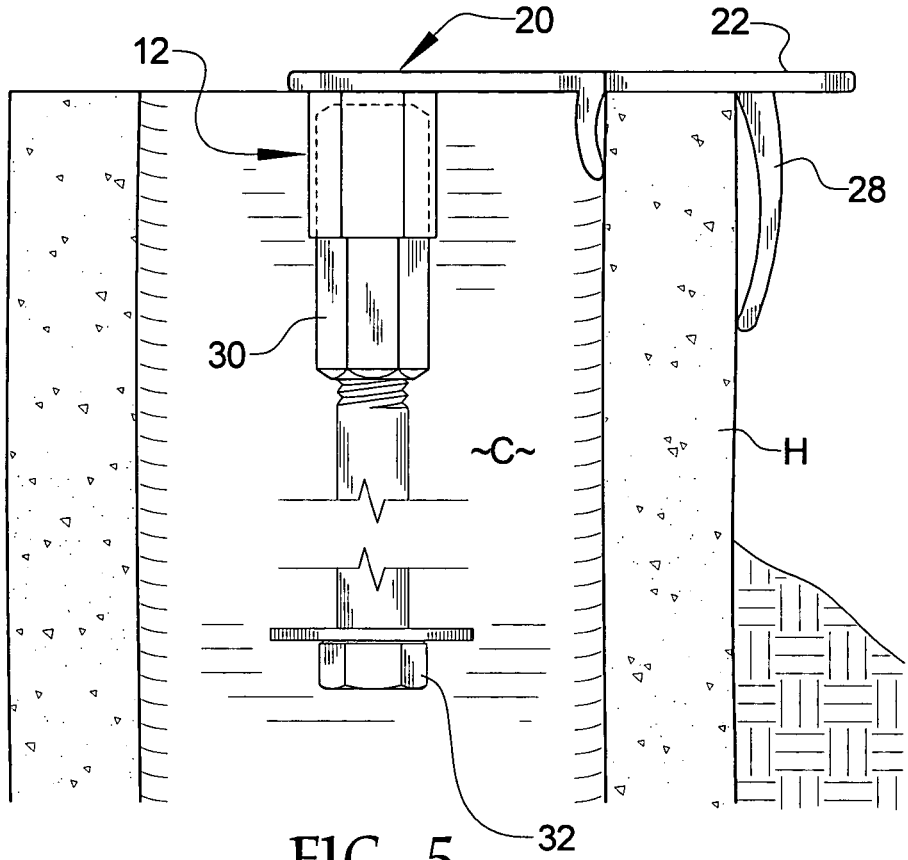
FIG. 5 is an elevation view of the wall anchoring system secured within a concrete block cavity prior to concrete pour.
Figure 6:
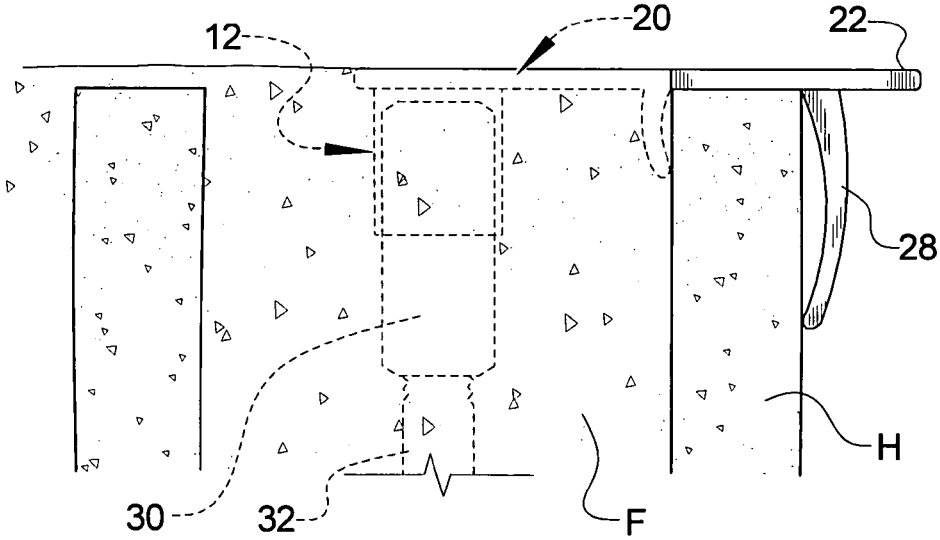
FIG. 6 is an elevation view of the wall anchoring system secured within a concrete block cavity after concrete pour.
Figure 7:
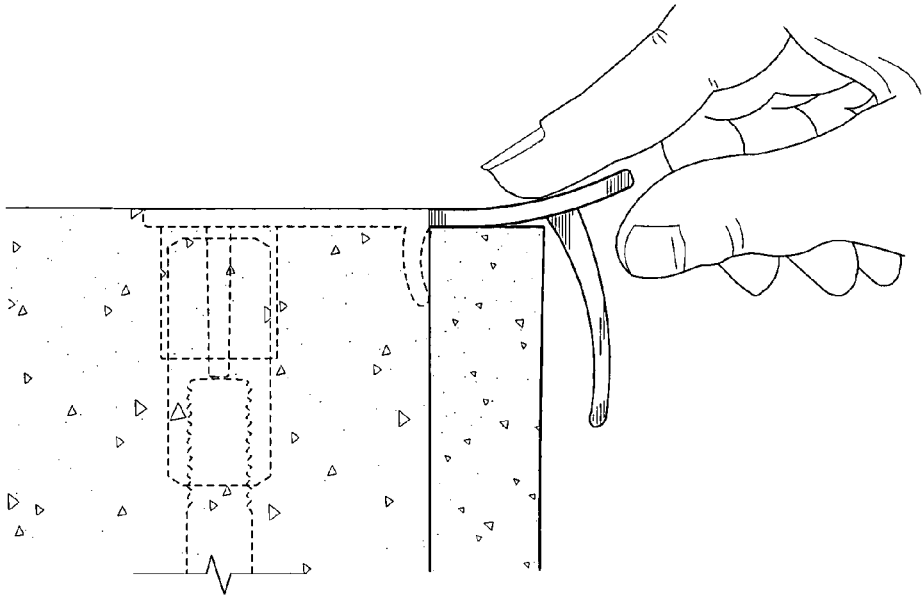
FIG. 7 is an elevation view of the wall anchoring system secured within the foundation with the sealing tab being removed.
Figure 8:
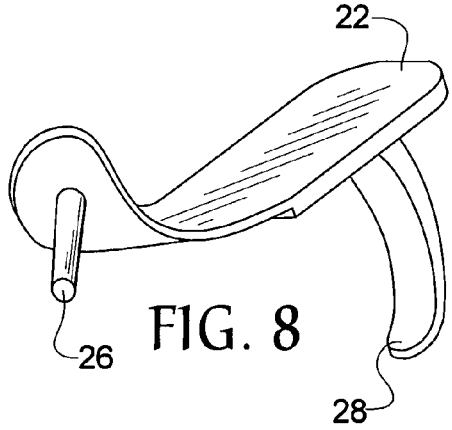
FIG. 8 is a perspective view of the sealing tab.
Figure 9:
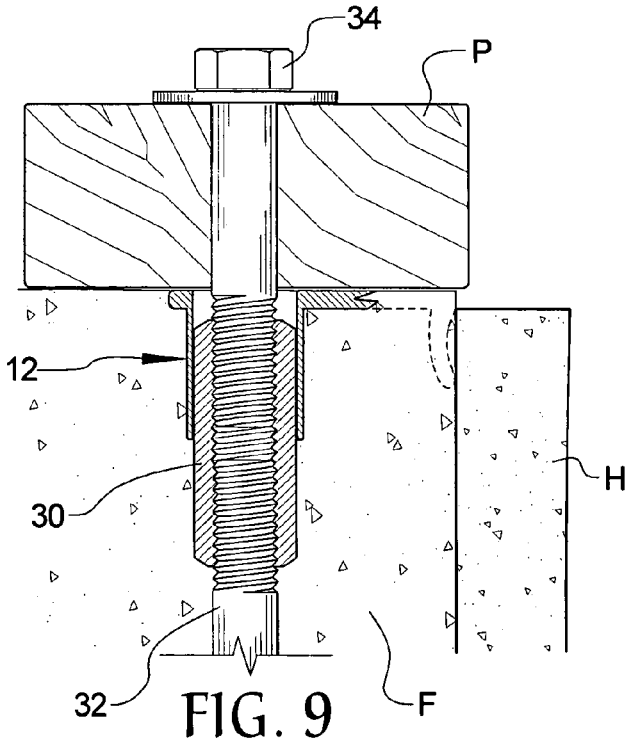
FIG. 9 is a partially sectioned view of the wall anchoring system securing the base plate of a stud wall to the foundation.

Referring now to the drawings, it is seen that the wall anchoring system of the present invention, generally denoted by reference numeral 10, is comprised of an anchor 12 that has a cavity 14 therein with an open bottom 16 and an open top 18. A seal housing 20 is attached to the anchor 12. The seal housing 20 has a seal tab 22 that removably covers the open top 18 of the anchor 12. The seal tab 22, which is generally flush with the remainder of the seal housing 20, is frangibly connected to the seal housing 20 such that a perforation line 24 or a score line comprises this frangible connection. A depth gauge 26 is located on the bottom surface of the seal tab 22 such that the depth gauge 26 is received within the cavity 14 of the anchor 12 and faces toward the open bottom 16 of the anchor 12 whenever the seal tab 22 is in covering relationship with the open top 18 of the anchor 12. A clip 28 is attached to the seal housing 20 and is laterally offset from the anchor 12 via the seal housing 20. The clip 28 may be integral with the seal housing 20 such that a portion of the clip 28 is located on the main body of the seal housing 20 and the other portion of the clip 28 being located on the seal tab 22, as best illustrated in FIGS. 1-8. In such an embodiment, the clip 28 is fixedly attached to the seal housing 20. In this embodiment of the wall anchoring system 10, the entire device 10 may be made from plastic in order to reduce weight and minimize cost, although metal and other materials may be used to construct the device 10. The clip 28 must have sufficient resiliency in order to be able to clip to an appropriate location, as described infra, and the seal tab 22 must be sufficiently resilient in order to allow the seal tab 22 to be readily peeled away from the seal housing 20 along the frangible connection 24. In order to use the wall anchoring system 10, a connector 30 having an anchor bolt 32 threadably received therein, is received within the open bottom 16 of the anchor 12. The depth gauge 26 of the seal tab 22 helps control the amount of insertion of the anchor bolt 32 into the connector 30 whenever the connector 30 is received within the open bottom 16 of the anchor 12, advantageously the anchor bolt 32 should be threadably positioned about half way into the connector 30. The device 10 is positioned within a concrete block cavity C such that the clip 28 clips onto the concrete block header H at the desired location. The lateral offset of the clip 28 with the anchor 12 provides the appropriate offset for the securement bolt 34 with the edge of the foundation. When appropriately positioned, the top of the device 10 is just slightly above the top of the header H. The concrete F for the foundation is poured in the usual way and screeded and leveled. As the wall anchoring system 10 is just above the top of the header H and the concrete F is typically poured to a level just above the top of the header H, the device 10 does not interfere with the screeding or leveling process, allowing an appropriate finish to be occasioned upon the foundation F being poured. After the foundation F has appropriately set, the seal tab 22 is grasped and removed from the remainder of the seal housing 20 exposing the open top 18 of the anchor 12. As seen, an end of the seal tab 22 extends beyond the header H making location and grasping of the seal tab 22 for peeling the seal tab 22 away from the remainder of the seal housing 20 relatively straightforward. As any concrete that may overlie the seal housing 20 is minimal, pulling on the seal tab 22 will allow this small amount of concrete to break away. Thereafter, the base plate P of the stud wall is positioned and a securement bolt 34 passes through the base plate P and through the open top 18 of the anchor 12 and is threadably received within the connector 30 (the term securement bolt 34 being broadly interpreted to include rods, cables, etc.). The anchor 12 and anchor bolt 32 are set firmly within the concrete foundation F, with the securement bolt 34 received within the connector 30 thereby anchoring the base plate P and the attached stud wall, to the foundation F.

Figure 10:
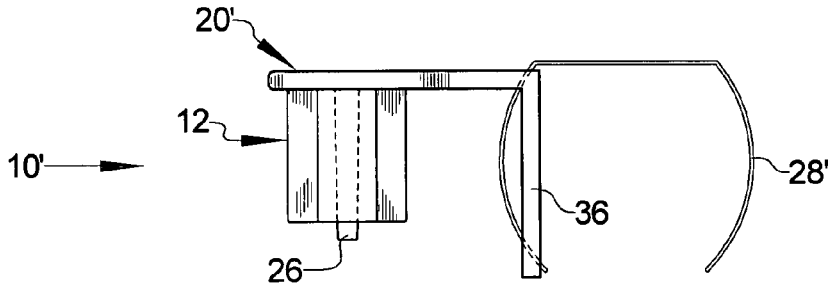
FIG. 10 is a side elevation view of an alternate embodiment of the wall anchoring system of the present invention.
Figure 11:
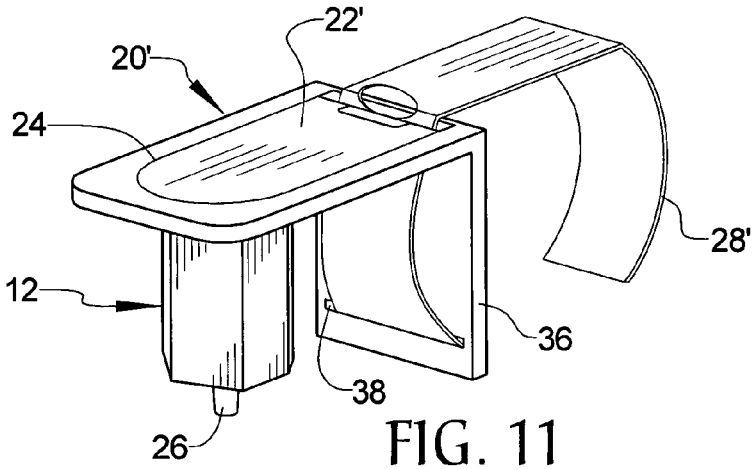
FIG. 11 is a perspective view of the wall anchoring system of FIG. 10.
Figure 12:
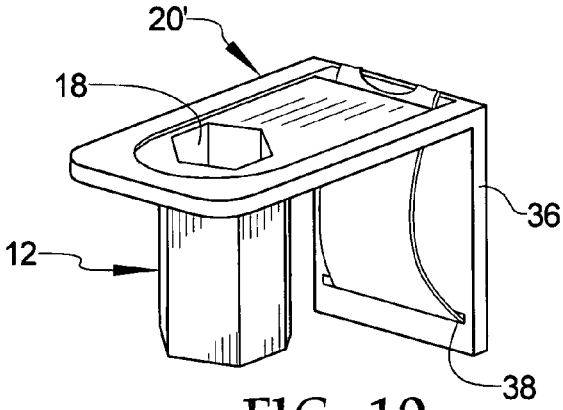
FIG. 12 is a perspective view of the wall anchoring system of FIG. 10 with the sealing tab and the clip removed.
Figure 13:
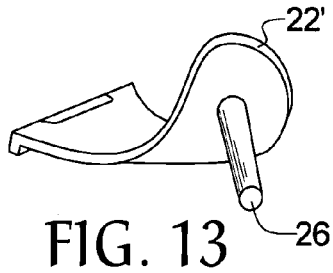
FIG. 13 is a perspective view of the tab used with the alternate embodiment of the wall anchoring system.
Figure 14:
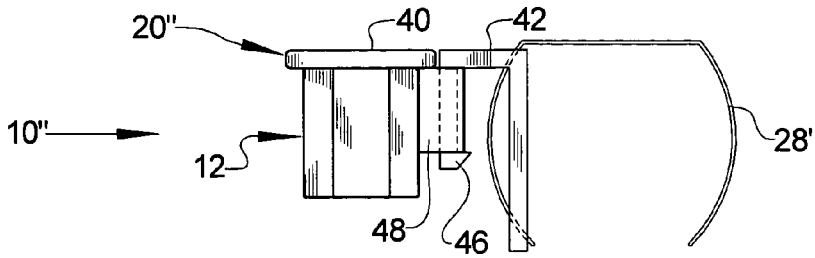
FIG. 14 is a side elevation view of a second alternate embodiment of the wall anchoring system of the present invention.
Figure 15:
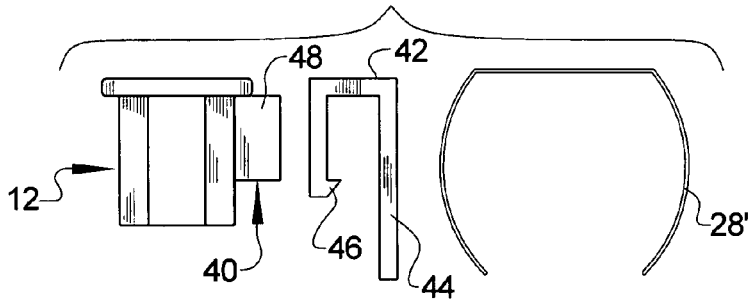
FIG. 15 is an exploded view of the wall anchoring system of FIG. 14.

As seen in FIGS. 10-12, in an alternate embodiment of the wall anchor system 10' the clip 28' may be removably attached to the seal housing 20' by providing the seal housing 20' with a downwardly oriented leg 36 that has one or more slots 38. The clip 28', which may be made from metal, passes through the slots 38 in order to secure the clip 28' to the seal housing 20'. In this embodiment, the clip 28' is positioned through the slots 38 and the device 10' is attached to the concrete block header H in the usual way. Once the foundation is poured. the clip 28' may be removed from within the slots 38 of the seal housing 20' with a screw driver or similar tool. This exposes the end of the seal tab 22 in order to allow the seal tab 22' to be grasped and removed or also removed with a screw driver or similar tool.

As seen in FIGS. 14-17, the seal housing 20" may be constructed from two sections, a first section 40 that securely attaches to the anchor 12 and a second section 42 that is removably attachable to the first section 40, this second section 42 having a leg 44 with one or more slots 38 for receiving the clip 28' thereinto. Removable attachment of the first section 40 from the second section 42 can be accomplished in any appropriate fashion such as by using the illustrated hook 46 located on the second section 42 that is received within a corresponding hook receiver 48 located on the first section. The use of two sections 40 and 42, allows the distance of lateral separation between the clip 28' (and thus the header H) and the anchor 12 to be controlled in accordance with the specifics of the wall being constructed. This wall anchoring system 10" works in similar fashion to the other embodiments of the wall anchoring system 10 and 10'.

Figure 16:
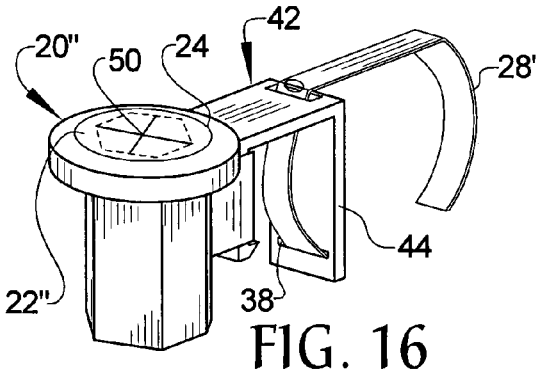
FIG. 16 is a perspective view of the wall anchoring system of FIG. 14.
Figure 17:
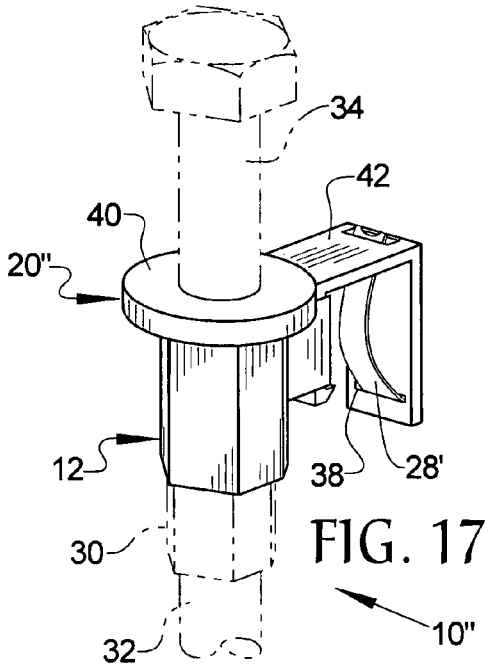
FIG. 17 is a perspective view of the wall anchoring system of FIG. 14 with the clip removed and the sealed punctured.

As seen in FIG. 16, the seal tab 22" may be designed to be punctured as opposed to being pealed away from the seal housing in order to expose the open top 18 of the anchor 12 for securement bolt 34 insertion. The perforation line 24 establishing the frangible connection of seal tab 22" with seal housing 20" is circular. A locator mark 50 may be located on a top surface of the seal tab 22" in order to give the user a visual point of reference for the point of puncture. This seal tab 22", which may be used with the other embodiments of the wall anchoring system 10 and 10' also has a depth gauge thereon to control depth of insertion of the anchor bolt 32 within the connector 30.

While the invention has been particularly shown and described with reference to embodiments thereof, it will be appreciated by those skilled in the art that various changes in form and detail may be made without departing from the spirit and scope of the invention.

I claim:

1. An anchoring system for securing a base plate to a foundation, the anchoring system comprising:

an anchor having an open bottom and an open top;

a seal housing attached to the anchor the seal housing having a seal tab removably covering the open top;

a clip attached to the seal housing and laterally offset from the anchor; and wherein the clip is adapted to be attached to a concrete block and a connector having an anchor bolt is adapted to be received within the anchor and once the foundation is poured, the seal tab is removed from the anchor exposing the open top such that a securement bolt threadably passes through the base plate and is received within connector through the open top and such that the seal tab has a depth gauge thereon that extends toward the bottom of the anchor whenever the seal tab is in covering relationship with the top such that the depth gauge controls the depth of insertion of the anchor bolt into the connector whenever the connector is received within the bottom of the anchor.

2. The anchoring system as in claim 1 wherein the seal tab is frangibly connected to the seal housing and is removed from the seal housing along this frangible connection.

3. The anchoring system as in claim 1 wherein the clip is removably attached to the seal housing.

4. The anchoring system as in claim 1 wherein the clip is received within a pair of slots located on the seal housing.

5. The anchoring system as in claim 1 wherein the seal tab is removed from covering relationship with the open top by being punctured.

6. The anchoring system as in claim 1 wherein the seal housing is comprised of a first section attached to the anchor and a second section removably attached to the first section with the clip attached to the second section, the second section providing the lateral offset between the anchor and the clip.

7. The anchoring system as in claim 6 wherein the clip is removably attached to the second section.

8. The anchoring system as in claim 7 wherein the clip is received within a pair of slots located on the second section.

9. The anchoring system as in claim 1 further comprising:

a connector having an anchor bolt received therein, the connector received within the open bottom of the anchor; and a securement bolt.

10. An anchoring system for securing a base plate to a foundation, the anchoring system comprising:

an anchor having an open bottom and an open top;

a seal housing attached to the anchor the seal housing having a seal tab removably covering the open top;

a clip removably attached to the seal housing and laterally offset from the anchor; and wherein the clip is adapted to be attached to a concrete block and a connector having an anchor bolt is adapted to be received within the anchor and once the foundation is poured, the seal tab is removed from the anchor exposing the open top such that a securement bolt threadably passes through the base plate and is received within connector through the open top.

11. The anchoring system as in claim 10 wherein the seal tab is frangibly connected to the seal housing and is removed from the seal housing along this frangible connection.

12. The anchoring system as in claim 10 wherein the clip is received within a pair of slots located on the seal housing.

13. The anchoring system as in claim 10 wherein the seal tab is removed from covering relationship with the open top by being punctured.

14. The anchoring system as in claim 10 wherein the seal housing is comprised of a first section attached to the anchor and a second section removably attached to the first section with the clip attached to the second section, the second section providing the lateral offset between the anchor and the clip.

15. The anchoring system as in claim 10 further comprising:

a connector having an anchor bolt received therein, the connector received within the open bottom of the anchor; and a securement bolt.

16. An anchoring system for securing a base plate to a foundation, the anchoring system comprising:

an anchor having an open bottom and an open top;

a seal housing attached to the anchor the seal housing having a seal tab removably covering the open top wherein the seal tab is removed from covering relationship with the open top by being punctured;

a clip attached to the seal housing and laterally offset from the anchor; and wherein the clip is adapted to be attached to a concrete block and a connector having an anchor bolt is adapted to be received within the anchor and once the foundation is poured, the seal tab is removed from the anchor exposing the open top such that a securement bolt threadably passes through the base plate and is received within connector through the open top.

17. The anchoring system as in claim 16 wherein the seal housing is comprised of a first section attached to the anchor and a second section removably attached to the first section with the clip attached to the second section, the second section providing the lateral offset between the anchor and the clip.

18. The anchoring system as in claim 17 wherein the clip is removably attached to the second section.

19. The anchoring system as in claim 18 wherein the clip is received within a pair of slots located on the seal housing.

20. The anchoring system as in claim 17 further comprising:

a connector having an anchor bolt received therein, the connector received within the open bottom of the anchor; and a securement bolt.

21. An anchoring system for securing a base plate to a foundation, the anchoring system comprising:

an anchor having an open bottom and an open top;

a seal housing attached to the anchor the seal housing having a seal tab removably covering the open top;

a clip attached to the seal housing and laterally offset from the anchor; and wherein the clip is adapted to be attached to a concrete block and a connector having an anchor bolt is adapted to be received within the anchor and once the foundation is poured, the seal tab is removed from the anchor exposing the open top such that a securement bolt threadably passes through the base plate and is received within connector through the open top and wherein the seal housing is comprised of a first section attached to the anchor and a second section removably attached to the first section with the clip attached to the second section, the second section providing the lateral offset between the anchor and the clip.

22. The anchoring system as in claim 21 wherein the clip is received within a pair of slots located on the second section.

23. The anchoring system as in claim 21 further comprising:

a connector having an anchor bolt received therein, the connector received within the open bottom of the anchor; and a securement bolt.

* * * * *